US011234488B2

(12) United States Patent
Amis et al.

(10) Patent No.: US 11,234,488 B2
(45) Date of Patent: Feb. 1, 2022

(54) SHOE UPPER WITH FLOATING LAYER

(71) Applicant: NIKE, Inc., Beaverton, OR (US)

(72) Inventors: Sam Amis, Portland, OR (US); Vianney de Montgolfier, Portland, OR (US); Gjermund Haugbro, Beaverton, OR (US); James Hwang, Taichung (TW); Daniel A. Johnson, Portland, OR (US); Tetsuya T. Minami, Portland, OR (US)

(73) Assignee: NIKE, INC., Beaverton, OR (US)

( * ) Notice: Subject to any disclaimer, the term of this patent is extended or adjusted under 35 U.S.C. 154(b) by 414 days.

(21) Appl. No.: 15/459,932

(22) Filed: Mar. 15, 2017

(65) Prior Publication Data

US 2018/0263338 A1 Sep. 20, 2018

(51) Int. Cl.
*A43C 5/00* (2006.01)
*A43B 9/02* (2006.01)
(Continued)

(52) U.S. Cl.
CPC ..... *A43B 23/026* (2013.01); *A43B 5/00* (2013.01); *A43B 5/025* (2013.01); *A43B 9/02* (2013.01);
(Continued)

(58) Field of Classification Search
CPC . A43B 23/026; A43B 23/021; A43B 23/0215; A43B 23/023; A43B 23/0265; A43B 23/0275; A43B 23/027; A43B 23/0245; A43B 23/00; A43B 23/07; A43B 5/00; A43B 5/025; A43B 5/02; A43B 5/06; A43B 9/02
(Continued)

(56) References Cited

U.S. PATENT DOCUMENTS 7,793,426 B2 * 9/2010 Byrne ..... A43B 7/06 36/3 A
8,312,646 B2 * 11/2012 Meschter ..... B29C 65/02 36/45
(Continued)

FOREIGN PATENT DOCUMENTS

EP 1495690 A1 1/2005
WO 9003744 A1 4/1990
WO WO-2015160421 A1 * 10/2015 ..... A43B 1/04

OTHER PUBLICATIONS

PCT International Search Report and Written Opinion in Application No. PCT/US2018/021588 dated May 14, 2018, 15 pages.
(Continued)

*Primary Examiner* — Jameson D Collier
(74) *Attorney, Agent, or Firm* — Shook Hardy & Bacon, LLP

(57) ABSTRACT

An article of footwear, such as a shoe, includes an upper and a sole. The upper may be formed with an outer layer and a floating textile layer relative to one or more portions of the outer layer. The floating textile layer has an apparent elongation that is less than an apparent elongation of the outer layer in response to an equal tensile force applied to each of the floating textile layer and the outer layer along a same axis of orientation. The differential in apparent elongation of the outer layer and the floating textile layer may increase wearability and functionability of the upper.

18 Claims, 10 Drawing Sheets

(51) Int. Cl.
*A43B 23/02* (2006.01)
*A43B 5/00* (2006.01)
*A43B 5/02* (2006.01)

(52) U.S. Cl.
CPC ..... *A43B 23/021* (2013.01); *A43B 23/027* (2013.01); *A43B 23/0215* (2013.01); *A43B 23/0235* (2013.01); *A43B 23/0265* (2013.01); *A43B 23/0275* (2013.01); *A43C 5/00* (2013.01)

(58) Field of Classification Search
USPC ..... 36/93, 3 A, 45, 55, 88, 91, 97
See application file for complete search history.

(56) References Cited

U.S. PATENT DOCUMENTS 8,631,589 B2 * 1/2014 Dojan ..... A43B 23/0275 36/45
8,869,435 B2 * 10/2014 Hatfield ..... A43B 5/001 36/102
2006/0196079 A1 * 9/2006 Terlizzi ..... A43B 5/12 36/8.3
2008/0083138 A1 * 4/2008 Lacorazza ..... A43B 3/26 36/97
2010/0064547 A1 3/2010 Kaplan et al.
2010/0180469 A1 * 7/2010 Baucom ..... A43B 3/0031 36/100
2011/0088285 A1 4/2011 Dojan et al.
2011/0258881 A1 * 10/2011 Mateo ..... A43B 5/00 36/114
2012/0011744 A1 1/2012 Bell et al.
2014/0237858 A1 * 8/2014 Adami ..... A43B 23/0205 36/107
2014/0377488 A1 * 12/2014 Jamison ..... A43B 1/04 428/36.1
2015/0047230 A1 * 2/2015 Beers ..... A43B 1/0018 36/102
2015/0052778 A1 * 2/2015 Kirk ..... B32B 5/024 36/45

OTHER PUBLICATIONS

International Preliminary Report on Patentability dated Sep. 26, 2019 in International Patent Application No. PCT/US2018/021588, 9 pages.
Office Action received for European Patent Application No. 18712408.6, dated Sep. 3, 2020, 5 pages.
Intention to Grant received for European Patent Application No. 18712408.6, dated Jun. 2, 2021, 4 pages.

* cited by examiner

SHOE UPPER WITH FLOATING LAYER

CROSS-REFERENCE TO RELATED APPLICATIONS

Not applicable.

TECHNICAL FIELD

This disclosure relates to articles of footwear having a floating layer forming at least a portion of an upper portion of the article of footwear.

BACKGROUND

A shoe may be comprised of an upper and a sole. The upper is coupled with the sole to form a foot-receiving cavity. A wearer may don the shoe by inserting his/her foot into the foot-receiving cavity. The upper may then be secured to the wearer's foot, such as through a lacing system that tightens the upper on the wearer's foot. The upper may aid in transferring a force from the wearer through the sole to the ground. A reciprocating force may also be transferred from the ground through the sole and to the wearer.

When a wearer of a shoe engages in locomotion, a tensile force is transferred around the wearer's foot between the sole of the shoe and the upper of the shoe. For example, when the wearer is running in a first direction and changes direction to a second direction (e.g., a cut), the wearer plants his/her foot and pushes against a ground surface at a vector that causes the wearer to move in the second direction. By planting his/her foot, the wearer imparts a force necessary to change direction, and in some cases speeds up or slows down.

Focusing on the shoe, when the wearer plants his/her foot to change direction, the shoe will either maintain traction (i.e., the condition where the force imparted by the wearer does not overcome the frictional force resisting sliding along the surface) or lose traction (i.e., the condition where the force imparted by the wearer overcomes the frictional force resisting sliding along the surface). In addition to the possibility of a two-dimensional movement of the shoe relative to the surface (i.e., sliding) when the wearer plants their foot to change direction, movement in a third dimension relative to the surface is possible (i.e., tipping, roll over, etc.). For example, when the wearer plants their foot to change direction the wearer will either maintain balance (i.e., the condition where the wearer's line of gravity extended to the surface intersects their base of support) or lose balance (i.e., the condition where the wearer's line of gravity extended to the surface does not intersect their base of support) and tip over.

BRIEF DESCRIPTION OF THE DRAWINGS

The present invention is described in detail herein with reference to the attached drawing figures, which are incorporated herein by reference, wherein.

DETAILED DESCRIPTION

Figure 1:
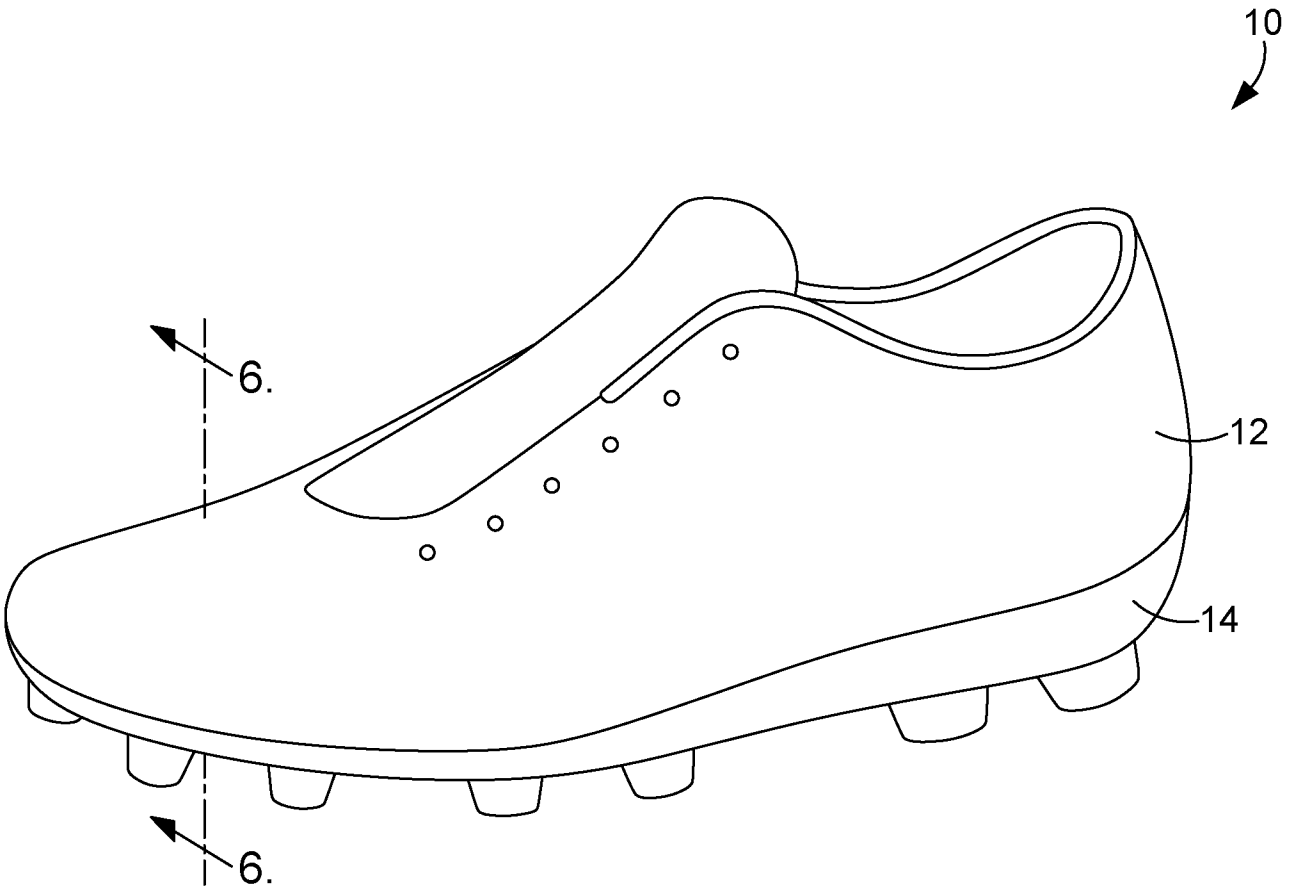
FIG. 1 depicts a perspective view of an exemplary shoe, in accordance with an aspect hereof.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the invention includes equivalent features, aspects, materials, methods of construction, and other aspects in embodiments not expressly described or depicted in this application in the interests of concision, but which would be understood by an ordinarily skilled artisan in the relevant art in light of the full disclosure provided herein as being included within the inventive scope. It will be understood that certain features and subcombinations are of utility and may be employed without reference to other features and subcombinations. This is contemplated by and is within the scope of the claims.

An article of footwear, such as an athletic shoe, a dress shoe, or a cleat, may be worn by a wearer to provide support, traction, impact attenuation, and the like. An article of footwear is referred to as a "shoe" herein for simplicity, but it is understood that the term shoe may include a variety of articles of footwear.

This application is generally directed to a shoe upper for enhanced performance during a change in direction when balance and traction are both maintained. When the wearer changes direction, the tensile force is transferred between the sole and the shoe upper. Repeated changes in direction result in repeated loads applied to the shoe upper, particularly to a lateral portion of the shoe upper and a medial portion of the shoe upper. Consequently, many reinforcements for the shoe upper have been proposed to increase durability of the shoe upper. For example, in some instances reinforcement stitching is sewn into the shoe upper between an eyestay and a footbed coupling portion. This reinforcement may linearly extend between an eyelet and the sole.

Unfortunately, this type of stitching reinforcement may result in "hot spots" that constrict the wearer's foot when a wearer changes direction and the tensile force is transferred between the lace portion and the sole. These "hot spots" may cause discomfort for the wearer.

At a high level, this disclosure generally relates to a shoe upper having at least a floating textile layer interior to, and with a lower apparent elongation than, an outer layer. For example, the floating textile layer may be a no-stretch/limited stretch material while the outer layer may be a stretch material relative to the floating textile layer, as will be discussed in greater detail hereinafter. In this configuration, the floating textile layer may carry a tensile force transferred through the shoe upper between a forefoot/midfoot region (e.g., a lace portion) and a sole of a shoe. In other aspects, the floating textile layer may comprise a no-stretch/limited stretch material along one or more axes and is a stretch material in directions normal to the one or more axes. In these aspects, at least one of the one or more axes is oriented in the direction of the tensile force transferred between the forefoot region and the sole of the shoe. As will be discussed in greater detail hereinafter, the terms "stretch" and "no stretch" may be used as terms of relativity. For example, a first material may have an apparent elongation (to also be discussed in greater detail hereinafter) that is greater than a second material. In this example, the first material may be referred to as a stretch material and the second material may be referred to as a no-stretch/limited stretch material.

The floating textile layer may remain free to move relative to the outer layer (i.e., the floating textile layer may "float" relative to the outer layer) in a portion the shoe upper between an eye stay (or equivalent portion in a midfoot/forefoot region) and a footbed coupling portion. This allows the layer carrying the load, the floating textile layer, to form fit around the foot of the wearer. In some aspects, the floating textile layer may be fixedly coupled to the outer layer only (or substantially only) along a portion of the eyestay and along the portion of a footbed coupling portion. As used herein, the term "substantially" references a primary, but not absolute, term. For example, the floating layer is substantially only fixedly coupled to the outer layer even if a few discrete bonds/stitches/coupling joints are included between the eye stay and footbed coupling portion. These relatively minor couplings may aid in registering the layers during manufacturing, aligning graphical elements, and the like. The floating textile layer may remain free to move relative to the outer layer in a portion of the shoe upper between the eyestay and the footbed coupling portion. This configuration spreads the tensile force transferred between the lace portion and the sole throughout the floating textile layer of the shoe upper and reduces "hot spots" while providing reinforcing strength to and formfitting of the shoe upper.

One aspect disclosed herein is directed to a shoe upper having an eyestay and a footbed coupling portion and comprising an outer layer having an inner surface and an outer surface and a floating textile layer having an inner surface and an outer surface. The outer surface of the floating textile layer may be fixedly coupled with the inner surface of the outer layer at the eyestay and the footbed coupling portion. An apparent elongation of the floating textile layer may be less than an apparent elongation of the outer layer in response to an equal tensile force applied to each of the floating textile layer and the outer layer along a same axis of orientation.

The outer layer may be comprised of polyurethane, leather, cast urethane, and digitally printed urethane. Additionally, the outer layer may be comprised of a knit, woven, braided, or non-woven material. The footbed coupling portion may be a rand or other portion to be joined with a sole below a biteline of the shoe upper. The shoe upper may further comprise the floating textile layer having a heel edge, a toe edge, a lateral rand edge (e.g., 17*a* in FIG. 3), a medial rand edge (e.g., 17*b* in FIGS. 3 and 5), and an eyestay edge. Each of the edges of the floating textile layer may be reinforced, in an exemplary aspect, with a bonding material to prevent the floating textile layer from fraying, tearing, or unraveling at the edges. In some aspects, the toe edge may terminate at a position rearward of a forwardmost end of a toe box portion of the shoe upper. Terms like rearwardmost and forwardmost are relative terms based on a longitudinal axis extending between a toe end and a heel end of the shoe. The toe end is relative to a forward direction and the heel end is relative to a rear direction. A filling material may extend forward from the toe edge to the forwardmost end of the toe box portion of the shoe upper. In other aspects, the heel edge of the floating textile layer may be forward of a forwardmost edge of a heel counter of the shoe upper.

The floating textile layer may be fixedly coupled with the outer layer by bonding, in accordance with some aspects. In other aspects, the floating textile layer may be fixedly coupled with the outer layer by stitching. The floating textile layer may only be fixedly coupled with the outer layer along a portion of the eyestay or other comparable portion in a forefoot region (e.g., proximate a throat opening) and along a portion of the footbed coupling portion. The eyestay may include a plurality of eyelets and each of the plurality of eyelets may comprise reinforced eyelets, such as through embroidery that may or may not extend through both the outer and floating layers as a coupling between the layers. The floating textile layer may be comprised of a quad-axial material, a tri-axial material, or a non-woven material. Multi-axial materials are discussed in greater detail hereinafter.

In some aspects, the shoe upper further comprises a lining affixed to the inner surface of the floating textile layer. An apparent elongation of the floating textile layer may be less than an apparent elongation of the lining in response to an equal tensile force applied to each of the floating textile layer and the lining along a same axis of orientation.

A second aspect provided herein is directed to a shoe having a sole coupled to a shoe upper proximate a footbed coupling portion of the shoe upper. The shoe upper may have an eyestay, a lateral edge, a toe edge, a medial edge, and a heel edge. The shoe upper may also have an outer layer having an inner surface and an outer surface and a floating textile layer having an inner surface and an outer surface. The outer surface of the floating textile layer may be fixedly coupled with the inner surface of the outer layer at the eyestay and along the lateral edge and medial edge proximate to the footbed coupling portion. The floating textile layer may be comprised of a quad-axial material, a tri-axial material, or a non-woven material.

In some aspects, the floating textile layer may be fixedly coupled with the outer layer substantially only at the eyestay and along the lateral edge and medial edge proximate to the footbed coupling portion. The sole is coupled to the shoe upper at one of a lasting board or a strobel board, in accordance with other aspects. The shoe upper may further comprise one or more additional layers. An apparent elongation of the floating textile layer may be less than an apparent elongation of the one or more additional layers in response to an equal tensile force applied to each of the floating textile layer and the one or more additional layers along a same axis of orientation. In one aspect, the one or more additional layers may be positioned exterior to the outer surface of the outer layer. In another aspect, the one or more additional layers may be positioned between the inner surface of the outer layer and the outer surface of the floating textile layer. In yet another aspect, the one or more additional layers may be positioned interior to the inner surface of the floating textile layer.

As used throughout this disclosure, the terms "securing" or "affixing" mean either releasably or permanently attaching objects together using affixing technologies such as stitching, bonding, welding, hook-and-loop fasteners, buttons, snaps, and the like.

As used throughout this disclosure, the term "apparent elongation" shall have the meaning ascribed such term in ASTM D5034-09 (Reapproved 2013). Generally, apparent elongation refers to the percentage change in length of an ungrasped portion of a test specimen when the test specimen is held on opposite ends and a tensile force (such as a breaking force) is applied to the test specimen. For example, a test specimen having an ungrasped portion measuring 5 inches before a breaking force is applied and measuring 5.5 inches after the breaking force is applied has an apparent elongation of 10%.

Turning now to the FIGS. 1-10, a shoe will now be discussed, in accordance with aspects hereof. Referring initially to FIG. 1, a shoe 10 may include a shoe upper 12 fixedly coupled with a sole 14 (114 in FIG. 10), in accordance with aspects hereof. The sole 14 may include an outsole, a midsole, an insole, or any other type of intermediate sole. Each of these types of soles will be collectively referred to hereinafter as the sole 14.

A shoe may have a toe end, an opposite heel end, a medial side, and an opposite lateral side. General regions may be provided in a shoe. For example, a forefoot region may extend from the toe end to a midfoot region. A heel region may extend from the heel end to the midfoot region. The midfoot region may include a distal end of a tongue and at least a portion of a throat opening (also sometimes referred to as a "U" opening). The forefoot region may include a vamp and a proximal portion of the tongue and the throat opening. The heel region may include an ankle opening and a heel counter. The midfoot region may also include a portion of the ankle opening as it converges with the throat. An eye stay may surround a portion of the throat. For example, an eye stay may extend from a medial side of the midfoot region toewardly to a toeward end of the throat in the forefoot region and then continue along the throat on the lateral side into the midfoot region, in an exemplary aspect. The eye stay may be one continuous component or a plurality of components, in an exemplary aspect. The term "eyestay" is inclusive of a traditional portion of a shoe upper through which one or more lace apertures extend. The term "eye stay" is also inclusive of alternative configurations where a traditional lacing aperture may not extend there through, where a lacing mechanism is omitted, where alternative fastening mechanisms (e.g., hook-and-loop, buckles, cables, elastic) are utilized, where a throat opening is omitted or altered, and the like in the traditional throat opening and/or tongue position. Therefore, the term "eyestay" encompasses a region in the midfoot and/or the forefoot regions traditionally associated with a throat opening regardless if such an opening is present or not.

Figure 2:
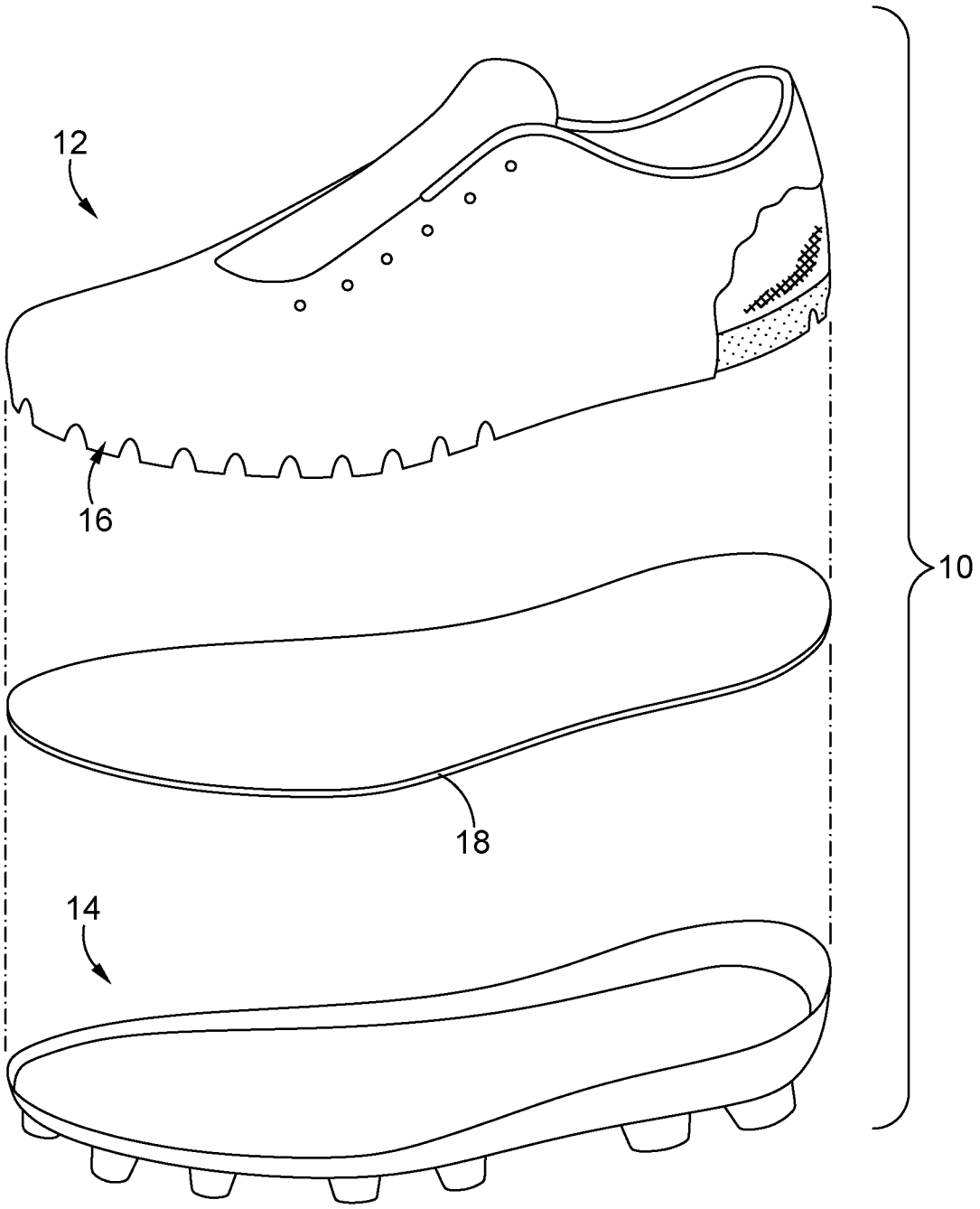
FIG. 2 depicts a exploded view of an exemplary shoe, in accordance with an aspect hereof.

Referring to FIG. 2, an exploded view of the shoe 10 of FIG. 1 is depicted showing a section cut away from a layer of the shoe upper 12 to reveal another layer beneath, in accordance with aspects hereof. The illustrated shoe upper 12 includes a footbed coupling portion 16 configured to fixedly couple the shoe upper 12 with the sole 14. For example, the shoe 10 may be constructed through a board lasting process such that the shoe upper 12 may be shaped around a last and secured to a lasting board 18 and in turn the lasting board 18 may be secured to the sole 14. In other aspects, the shoe upper 12 may be fixedly coupled through other manufacturing processes. For example, the shoe upper 12 may be stitched to a strobel board (not shown) through a strobel construction process. By way of further example, the shoe upper 12 may also be directly affixed to the sole 14. Regardless of what construction technique is used, the shoe upper 12 may be fixedly coupled to the sole 14 such that a tensile force may be transferred between a lacing portion and the sole 14 through the shoe upper 12.

Figure 4:
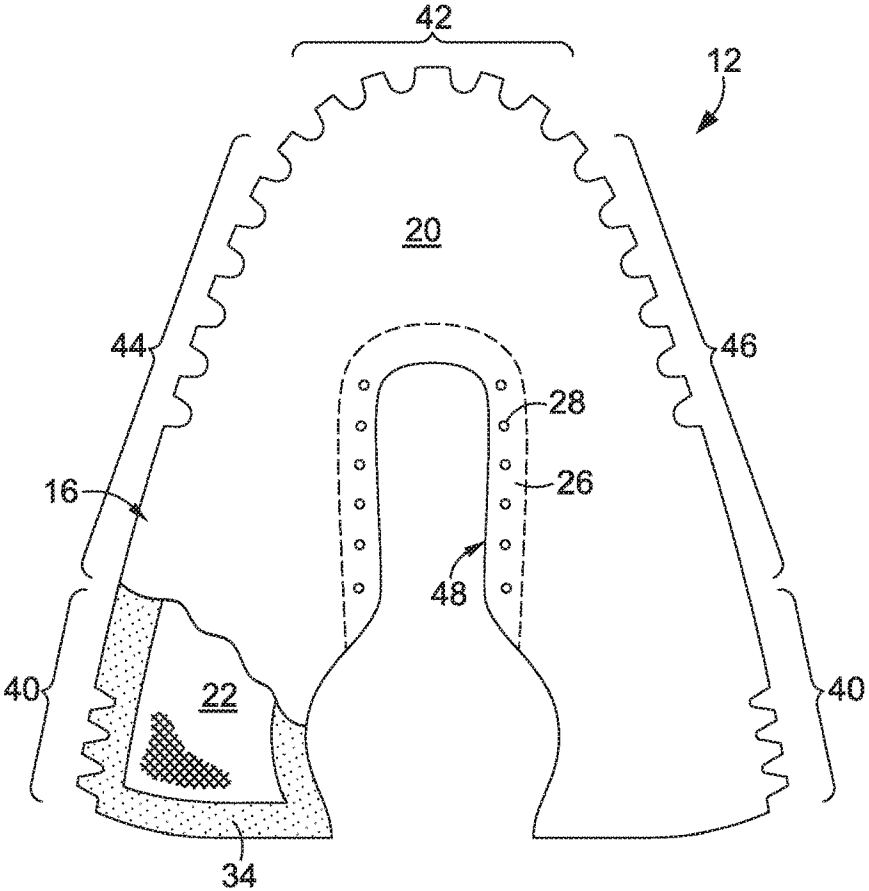
FIG. 4 depicts a top view of the exemplary shoe upper of FIG. 3 having a section broken away, in accordance with an aspect hereof.
Figure 3:
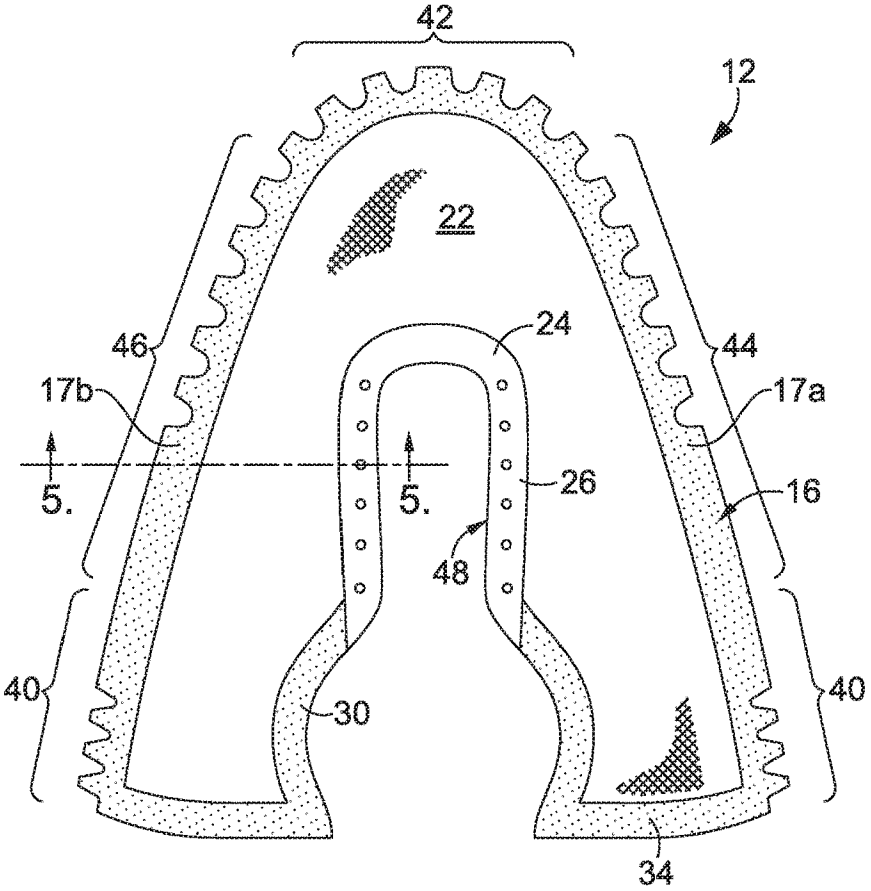
FIG. 3 depicts a bottom view of an exemplary shoe upper, in accordance with an aspect hereof.

Turning to FIGS. 3 and 4, a bottom view and a top view, respectively, of an exemplary shoe upper 12 is depicted assembled but not coupled to the shoe 10, in accordance with aspects hereof. The illustrated shoe upper 12 includes an outer layer 20 fixedly coupled with a floating textile layer 22. FIG. 4 has a section cut away from the outer layer 20 to reveal the floating textile layer 22 beneath. The shoe upper 12 may also include an eyestay 26 to reinforce a plurality of eyelets 28 spaced around a throat of the shoe upper 12. The illustrated shoe upper 12 also has an ankle collar 30, a heel edge 40, a toe edge 42, a lateral edge 44, a medial edge 46, and an eyestay edge 48.

The outer layer 20 may be fixedly coupled with the floating textile layer 22 along a portion of the eyestay 26 and along a part of the footbed coupling portion 16. In some aspects, the outer layer 20 may be fixedly coupled with the floating textile layer 22 only (or substantially only) at the eyestay 26 and at the footbed coupling portion 16. In other aspects, the outer layer 20 may be fixedly coupled with the floating textile layer 22 along the eyestay 26 and the ankle collar 30 and also at the footbed coupling portion 16 along each of the heel edge 40, lateral edge 44, toe edge 42, and medial edge 46. In still other aspects, the outer layer 20 is fixedly coupled with the floating textile layer 22 only at the eyestay 26 and the footbed coupling portion 16 without a material coupling in a quarter panel portion extending between the eyestay 26 and the footbed coupling portion 16, in an exemplary aspect.

The outer layer 20 may be comprised of polyurethane, leather, cast urethane, and digitally printed urethane. The outer layer 20 may also be comprised of any other suitable material, such as a knit, woven, braided, and/or non-woven material.

The floating textile layer 22 may be comprised of a material having a low apparent elongation in at least one direction, such as a textile composite. For example the floating textile layer 22 may be comprised of a quad-axial material, a tri-axial material, or another textile composite or even a non-woven material. A quad-axial material may relate to a material having fibers oriented in four different axes to restrain elongation along those axes, in accordance with some aspects. In other aspects, a quad-axial material relates to fabrics made up of four layers of parallel fibers laid in any four orientations, e.g., 0°, +45°, 90°, and −45°. A tri-axial material may relate to a material having fibers oriented in three different axes to restrain elongation along those axes, according to some aspects. In other aspects, a tri-axial material relates to fabrics made up of three layers of parallel fibers laid in any three orientations, e.g., +30°, 90°, and −30°. Hence, in an aspect where the floating textile layer 22 is comprised of a tri-axial material, the floating textile layer 22 may have increased strength, stiffness, and temperature resistance and decreased apparent elongation in a direction oriented with any of the three fiber layer orientations. Further, the floating textile layer 22 may retain a portion of its elasticity in a direction not oriented with any of the three fiber layer orientations.

The floating textile layer 22 may be constructed to orient one of the at least one direction of low apparent elongation such that it extends between the eyestay 26 and the footbed coupling portion 16. In other words, the at least one direction of low apparent elongation is oriented to carry the tensile force transferred between the lacing portion and the sole 14 when a wearer of the shoe 10 changes direction. Hence, the apparent elongation of the floating textile layer 22 may be less than the apparent elongation of the outer layer 20 in response to an equal tensile force applied to each of the floating textile layer 22 and the outer layer 20 along a same axis of orientation.

In some aspects, the floating textile layer 22 may include a reinforcement 34. The reinforcement 34 may be bonded to prevent damage due to wear, such as fraying, unraveling, etc. As shown in FIG. 3, the reinforcement 34 may extend around the perimeter of the floating textile layer 22.

Figure 5:
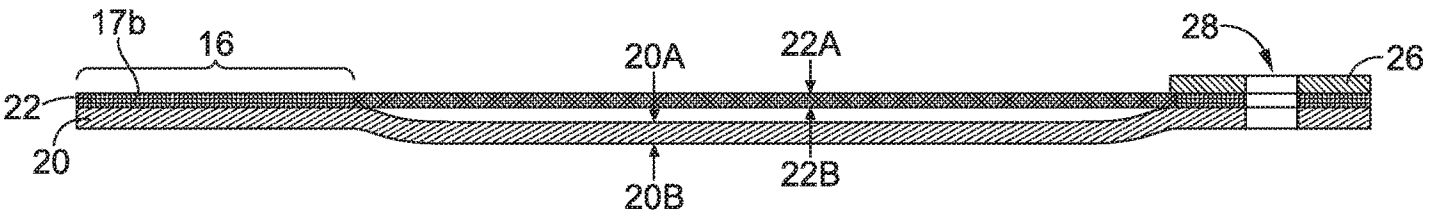
FIG. 5 depicts a cross-section view taken across cut line 5-5 in FIG. 3 of the exemplary shoe upper, in accordance with an aspect hereof.

Referring to FIG. 5, the outer layer 20 may have an inner surface 20A and an outer surface 20B and the floating textile layer 22 may have an inner surface 22A and an outer surface 22B, in accordance with aspects hereof. In the illustrated aspect, the inner surface 20A of the outer layer 20 is coupled to the outer surface 22B of the floating textile layer 22 at each of the eyestay 26 and the footbed coupling portion 16. In other aspects, one or more intermediate layers may be between the outer layer 20 and the floating textile layer 22 at one or both couplings.

The coupling between the outer layer 20 and the floating textile layer 22 permits the floating textile layer 22 to move freely relatively to the outer layer 20 at all uncoupled points (e.g., between the eyestay 26 and the footbed coupling portion 16). For example, when a wearer of the shoe 10 changes direction and a tensile force is transferred between the lacing portion and the sole 14, the outer layer 20 may elastically stretch without materially (e.g., while there may be an inherent transfer through the mere presence of the material, but a substantial portion of the transferred force is not transferred through the outer layer 20) carrying the transferred force while the floating textile layer 22 may not elastically stretch, or may minimally stretch relative to the outer layer 20, and carry the transferred force. Further, the floating textile layer 22 may conform to the shape of the wearer's foot and distribute the transferred load to limit "hot spots," a pinch point, or other potential irritants. As a result, it is contemplated that the outer layer 20, having a greater apparent elongation, forms to a foot and provides an appearance and/or fit while the floating textile layer 22 provides tensile force transfer with the shoe, in an exemplary aspect.

Figure 6:
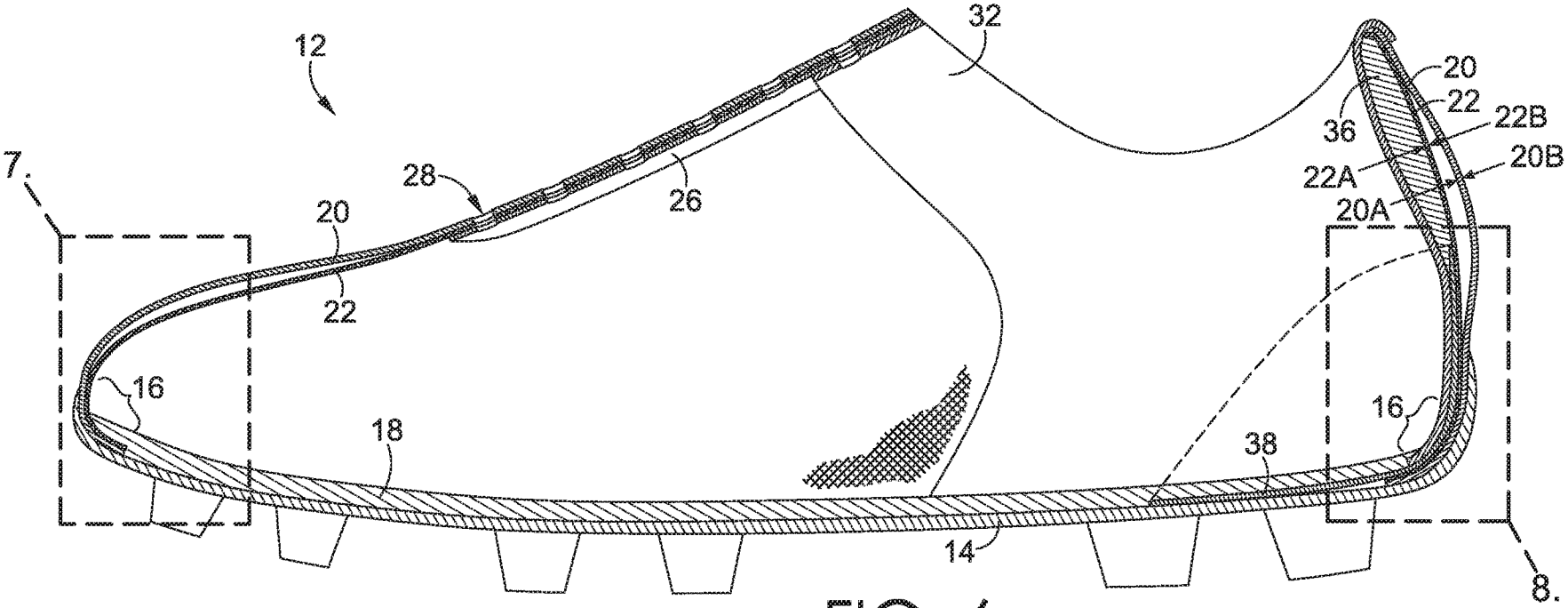
FIG. 6 depicts a cross-section view taken across cut line 6-6 in FIG. 1 of the exemplary shoe, in accordance with an aspect hereof.

As shown in FIG. 6, additional layers may be included in the shoe upper 12. For example, the shoe upper 12 may include a liner 32 coupled to the inner surface 22A of the floating textile layer 22. The additional layers that may be included in the shoe upper 12 may have an apparent elongation greater than the apparent elongation of the floating textile layer 22 in response to an equal tensile force applied to each of the floating textile layer 22 and the additional layers along the same axis of orientation. In other words, when a wearer of the shoe 10 changes directions and the tensile force is transferred between the sole 14 and the lacing portion the additional layers (such as the liner 32) may elastically stretch while the floating textile layer 22 substantially carries the transferred force. The shoe upper 12 may also include other shoe components, such a filler 36 between the liner 32 and the floating textile layer 22 and a heel counter 38, for example.

Figure 8:
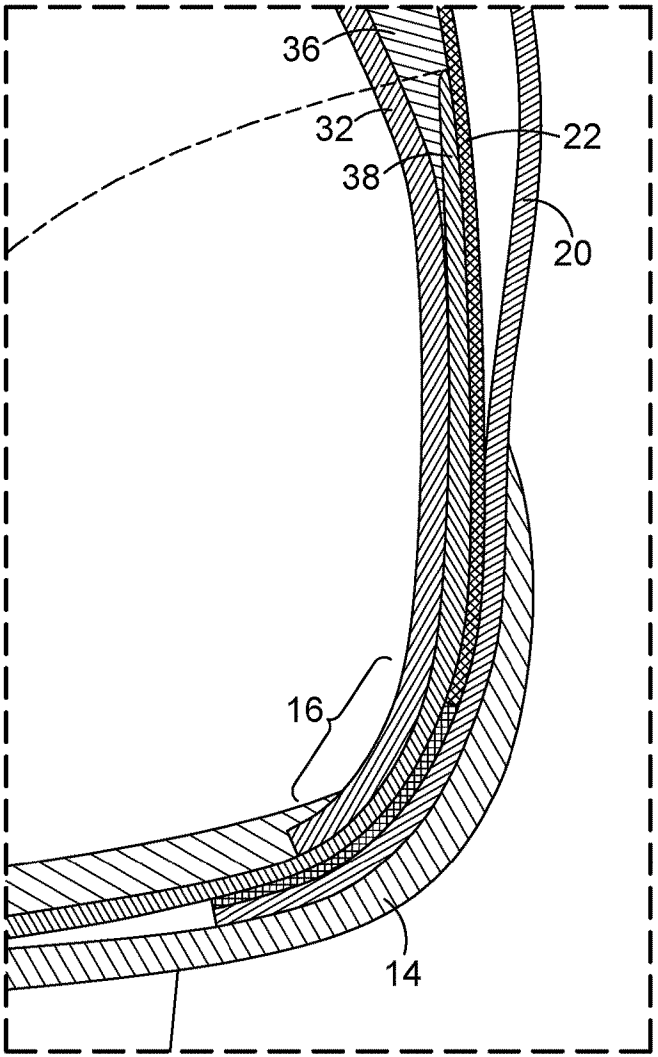
FIG. 8 depicts a section of the exemplary shoe of FIG. 6, in accordance with an aspect hereof.
Figure 7:
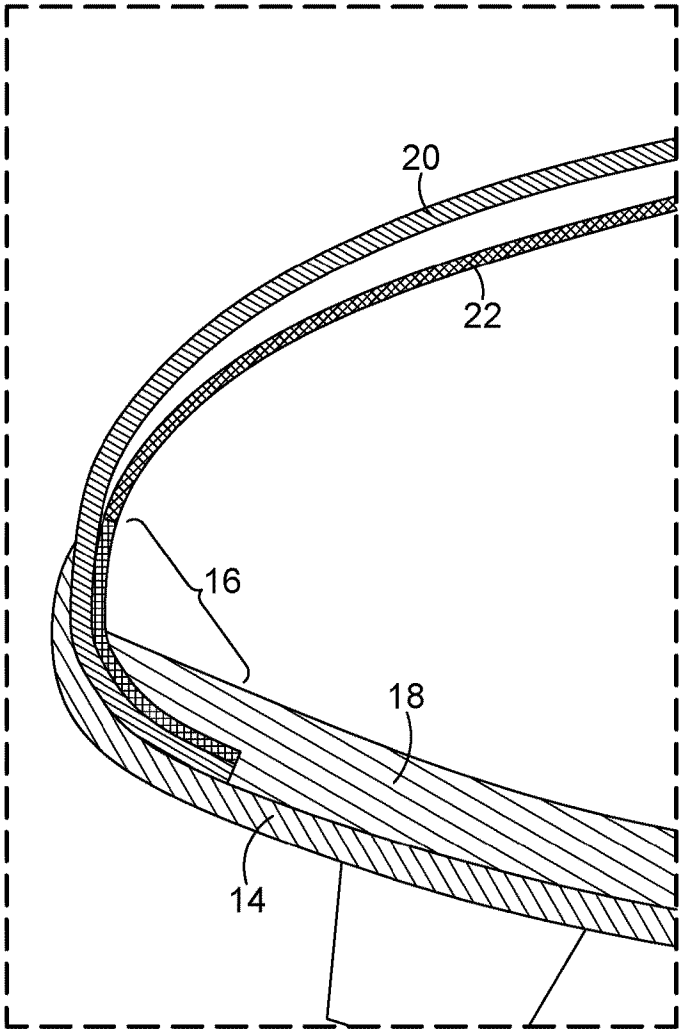
FIG. 7 depicts a section of the exemplary shoe of FIG. 6, in accordance with an aspect hereof.

Referring to FIGS. 7 and 8, the footbed coupling portion 16 is illustrated at a toe portion of the shoe 10 and a heel portion of the shoe 10, respectively, in accordance with aspects hereof. In the illustrated aspect, the outer layer 20 and the floating textile layer 22 are fixedly coupled to one another at the footbed coupling portion 16 and the footbed coupling portion wraps under and is attached to the lasting board 18. The lasting board 18 and a portion of the footbed coupling portion 16 are secured to the sole 14, in accordance with the illustrated aspect.

In some aspects, the outer layer 20 is bonded to the floating textile layer 22 at the footbed coupling portion 16 and the eyestay 26. For example, the outer layer 20 may be bonded to the floating textile layer 22 by chemical bonding, thermal bonding, and/or mechanical bonding. In other aspects, the outer layer 20 is stitched to the floating textile layer 22 at the footbed coupling portion 16 and the eyestay 26.

While the illustrated shoe 10 is constructed through board lasting techniques, the shoe 10 may also be constructed with alternative construction techniques such as Strobel construction. In other aspects, the shoe upper 12 may be fixedly coupled directly to the sole 14 or may be fixedly coupled to a top surface of the lasting board 18.

Although in the illustrated aspect there is a small gap depicted between the sole 14 and the lasting board 18 where the outer layer 20 and the floating textile layer 22 terminate beneath the lasting board 18, in other aspects the thickness of the outer layer 20 and the floating textile layer 22 may be small enough to minimize or eliminate the gap. In still other aspects, the sole 14 and/or the lasting board 18 may be shaped to minimize or eliminate the gap.

Figure 9:
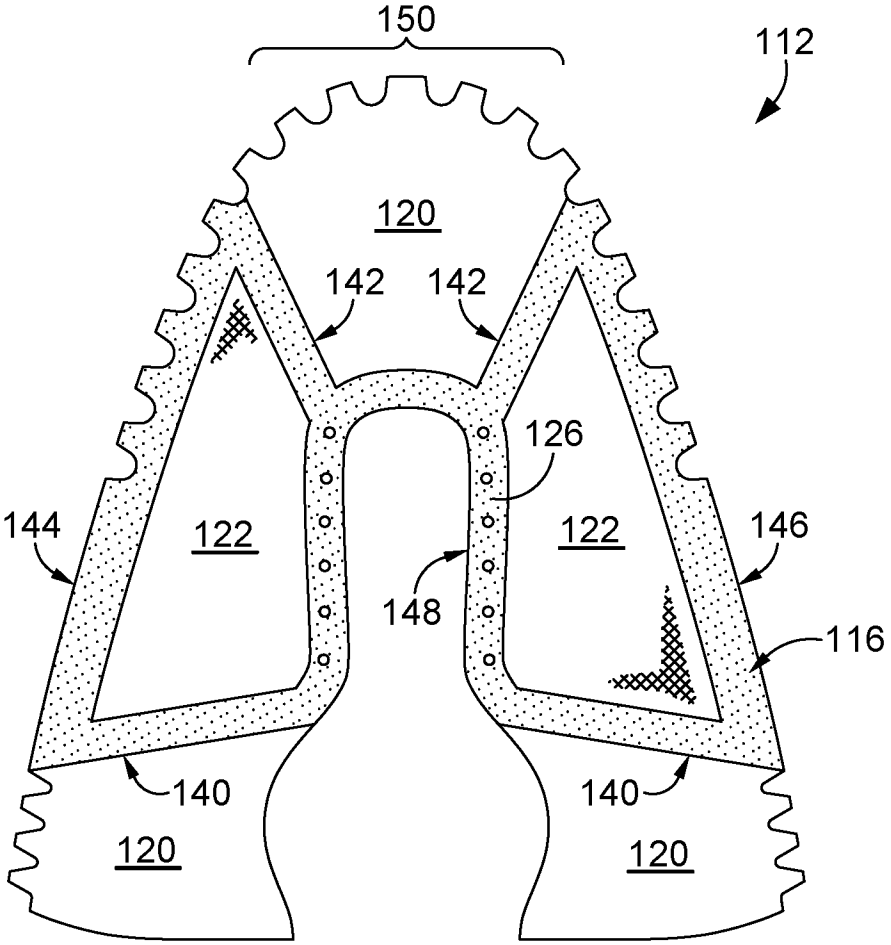
FIG. 9 depicts a bottom view of an exemplary shoe upper, in accordance with an aspect hereof.
Figure 10:
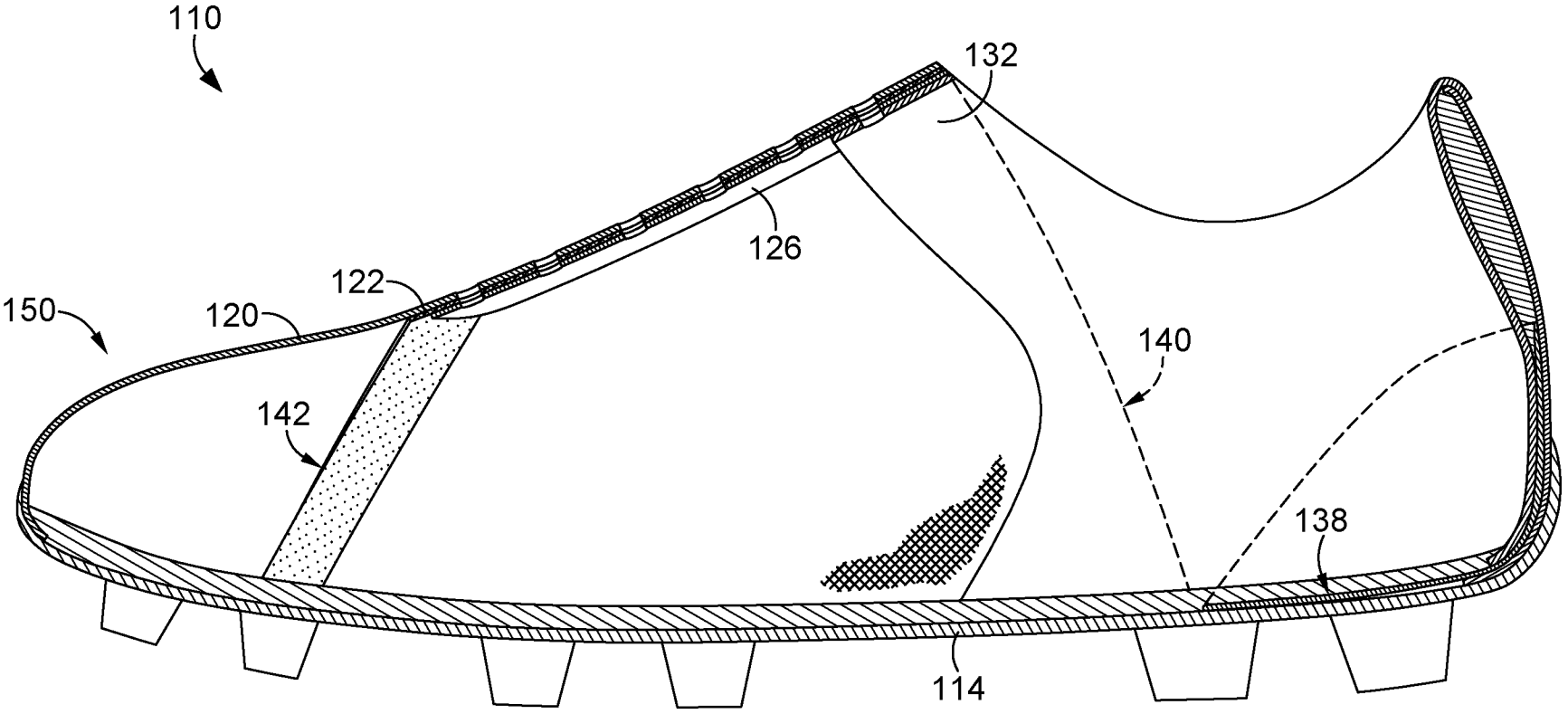
FIG. 10 depicts a cross-section view taken across cut line 6-6 in FIG. 1 of an exemplary shoe assembled with the exemplary shoe upper from FIG. 9, in accordance with an aspect hereof.

Turning now to FIGS. 9 and 10, another aspect of a shoe upper 112 is depicted, in accordance with aspects hereof. This aspect of the shoe upper 112 may have a different geometry than that of the shoe upper 12 previously discussed, but may still include many of the same features as the shoe upper 12. For example, the shoe upper 112 may include an outer layer 120 fixedly coupled with a floating textile layer 122. In some aspects, the outer layer 120 is fixedly coupled to the floating textile layer 122 at an eyestay 126 and a footbed coupling portion 116. The floating textile layer 122 may include a heel edge 140, a toe edge 142, a lateral edge 144, a medial edge 146, and an eyestay edge 148.

FIG. 10 depicts a cross-sectional view of an assembled shoe 110. The shoe 110 may be similar to the shoe 10 and include the shoe upper 112. The shoe 110 may also include a toe box 150, a liner 132, and a heel counter 138. The floating textile layer 122 may not extend to a forwardmost portion or a rearwardmost portion of the shoe 110. For example, the toe edge 142 of the illustrated floating textile layer 122 does not extend into the toe box 150 of the shoe 110. Similarly, the heel edge 140 of the illustrated floating textile layer does not extend rearward of a forwardmost edge of the heel counter 138. In other aspects, either the toe edge 142 or the heel edge 140 may extend to the forwardmost portion or the rearwardmost portion, respectively, while the other does not. For example, the toe edge 142 may extend to the toebox while the heel edge 140 does not extend to the heel counter 138, in an exemplary aspect.

Figure 11:
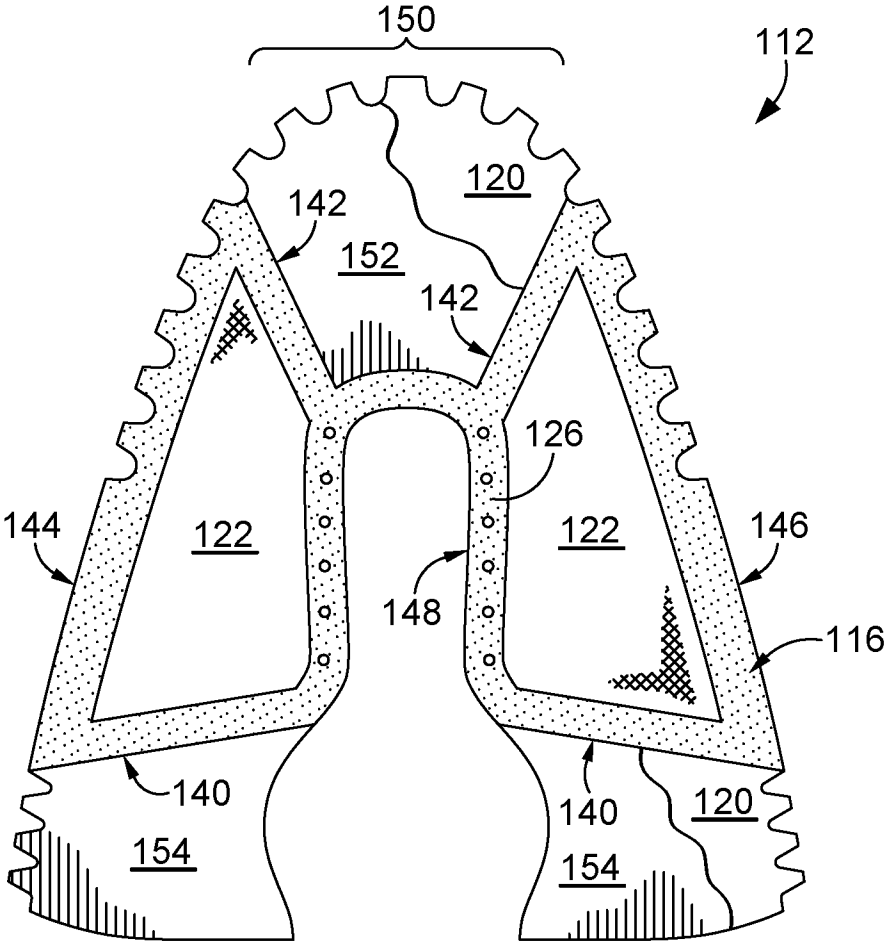
FIG. 11 depicts a bottom view of an exemplary shoe upper, in accordance with an aspect hereof.

Turning to FIG. 11, the shoe upper 112 may include a filling patch 152 that extends forward from the toe edge 142 to the forwardmost portion of the shoe upper 112. Similarly, the shoe upper 112 may include a filling patch 154 that extends rearward from the heel edge 140 to the rearward-most portion of the shoe upper 112. The filling patches 152 and 154 may extend proximate to the outer layer 120 and together with the floating textile layer 122 may provide a uniform thickness across the shoe upper 122. The floating textile layer 122 has an apparent elongation less than the apparent elongation of the outer layer 120 and the filling patches 152, 154, in accordance with some aspects.

Figure 12:
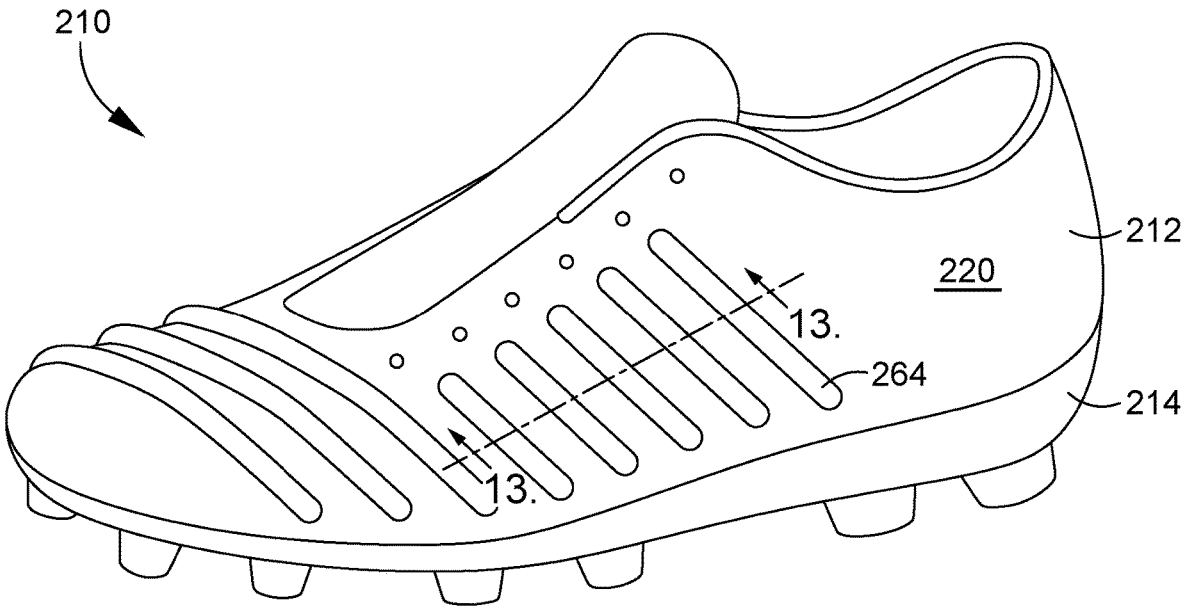
FIG. 12 depicts a perspective view of another exemplary shoe, in accordance with an aspect hereof.
Figure 13:
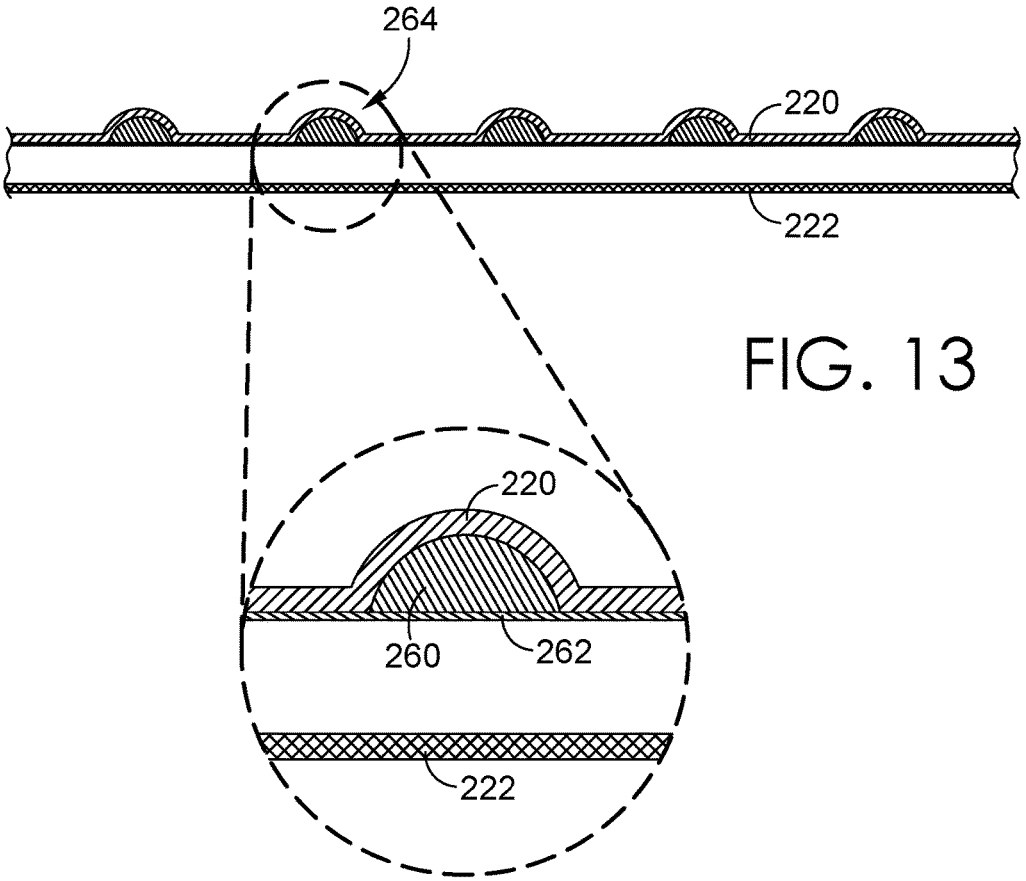
FIG. 13 depicts a cross-section view taken across cut-line 13-13 in FIG. 12 of the exemplary shoe upper, in accordance with an aspect hereof.

Turning now to FIGS. 12 and 13, another aspect of a shoe 210 is depicted. The shoe 210 may include a shoe upper 212 fixedly coupled with a sole 214. Similar to the aspects discussed above, the shoe upper 212 may include an outer layer 220 fixedly coupled with a floating textile layer 222. The shoe upper 212 may also include additional layers. In some aspects, the shoe upper 212 may include a foam layer 260. In other aspects, the shoe upper may include a foam retaining layer 262.

The foam layer 260 may be positioned adjacent to the interior surface of the outer layer 220. In some aspects, the foam layer 260 is affixed to the inner surface of the outer layer 220. The apparent elongation of the foam layer 260 may be greater than the apparent elongation of the floating textile layer 222 in response to an equal tensile force applied to each of the floating textile layer 222 and the foam layer 260 along a same axis of orientation.

The foam retaining layer 262 may be positioned interior to the outer layer 220 and the foam layer 260 such that the foam layer 260 is retained between the outer layer 220 and the foam retaining layer 262. In some aspects, the foam retaining layer 262 is affixed to the inner surface of the outer layer 220, the foam layer 260, or both the inner surface of the outer layer 220 and the foam layer 260. The apparent elongation of the foam retaining layer 262 may be greater than the apparent elongation of the floating textile layer 222 in response to an equal tensile force applied to each of the floating textile layer 222 and the foam retaining layer 262 along a same axis of orientation.

The floating textile layer 222 may be fixedly coupled to the outer layer 220 along a portion of an eyestay and along a part of the footbed coupling portion. In some aspects, the floating textile layer 222 may be affixed to an interior surface of the foam retaining layer 262 along a portion of an eyestay and along a part of the footbed coupling portion. Hence, the floating textile layer 222 may move freely relative to the outer layer 220, the foam layer 260 and the foam retaining layer 262, in accordance with some aspects.

Figure 14:
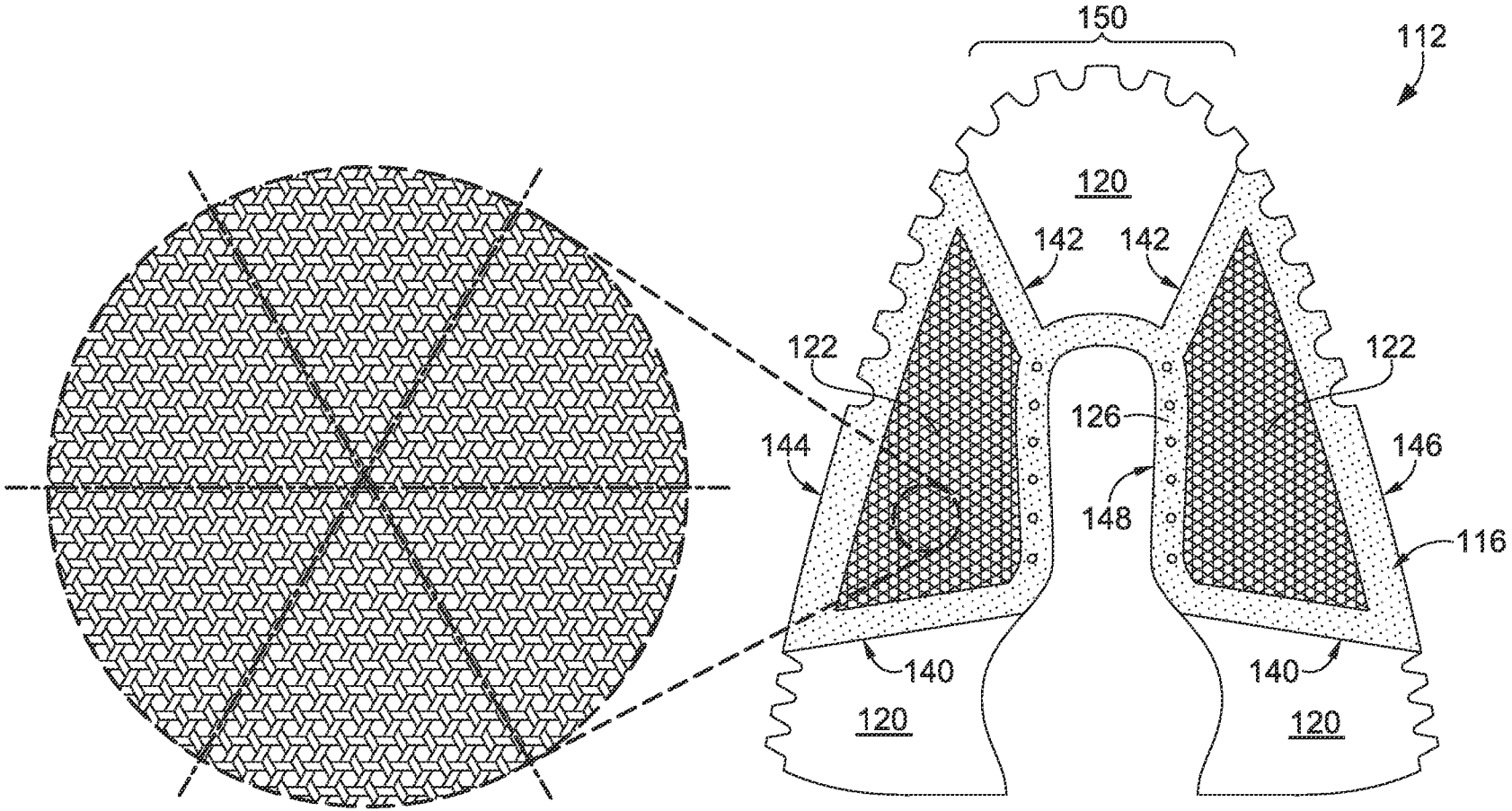
FIG. 14 depicts a section of the exemplary shoe having a multi-axial material, in accordance with an aspect hereof.

The outer layer 220 may be molded into a desired shape. For example, one or more surface structures 264 may be formed in the outer layer 220. In the illustrated aspect, the one or more surface structures 264 comprise channels formed in the inner surface of the outer layer 220, which manifest as ridges on the outer surface of the outer layer 220. The foam comprising the foam layer 260 may be die-cut to the specific geometry of the shoe upper 212 and need not comprise a single sheet of material. For example, the foam layer 260 of the illustrated aspect is die-cut to fit within the channels formed in the inner surface of the outer layer 220 and the foam retaining layer 262 holds the foam layer 260 within said channels. Other geometries and orientations of the surface structures 264 are foreseen and included within the scope of the present application. For example, FIG. 14 depicts that the shoe upper 122 may comprise a multi-axial fabric, such as the tri-axial fabric depicted in FIG. 14.

From the foregoing, it will be seen that aspects described herein are well adapted to attain all the ends and objects hereinabove set forth together with other advantages which are obvious and which are inherent to the structure. Since many possible aspects described herein may be made without departing from the scope thereof, it is to be understood that all matter herein set forth or shown in the accompanying drawings is to be interpreted as illustrative and not in a limiting sense.

What is claimed is:

1. A shoe upper comprising:

an eyestay;

a footbed coupling portion;

an outer layer having an inner surface and an outer surface, the outer layer extending in a first axis of orientation linearly from the eyestay to the footbed coupling portion; and a floating textile layer having an inner surface and an outer surface and comprising a multi-axial material having fibers extending along varied axes of orientation, the outer surface of the floating textile layer being fixedly coupled with the inner surface of the outer layer at the eyestay and at the footbed coupling portion, wherein the floating textile layer extends in a second axis of orientation linearly from the eyestay to the footbed coupling portion, wherein the first axis of orientation is aligned in a same direction with the second axis of orientation, and wherein an apparent elongation of the floating textile layer along the second axis of orientation is less than an apparent elongation of the outer layer along the first axis of orientation in response to an independently applied, equal tensile force; and wherein the multi-axial material comprises at least a first layer, a second layer, and a third layer, wherein the first layer comprises a first plurality of fibers extending in a first parallel orientation, the second layer comprises a second plurality of fibers extending in a second parallel orientation different than the first parallel orientation, and wherein the third layer comprises a third plurality of fibers extending in a third parallel orientation different than the first parallel orientation and the second parallel orientation.

2. The shoe upper of claim 1, wherein the outer layer comprises at least one selected from polyurethane, leather, cast urethane, or digitally printed urethane.

3. The shoe upper of claim 1, wherein the footbed coupling portion is a portion of a rand of the shoe upper.

4. The shoe upper of claim 1 further comprising:

the floating textile layer having a heel edge, a toe edge, a lateral rand edge, a medial rand edge, and an eyestay edge, wherein at least one of the heel edge, the toe edge, the lateral rand edge, the medial rand edge, and the eyestay edge of the floating textile layer is reinforced with a bonding material.

5. The shoe upper of claim 4, wherein the shoe upper further comprises a toe box portion, and wherein the toe edge of the floating textile layer terminates at a position rearward of a forward most end of the toe box portion of the shoe upper.

6. The shoe upper of claim 5 further comprising:

a filling material that extends forward from the toe edge of the floating textile layer to the forward most end of the toe box portion of the shoe upper adjacent to the inner surface of the outer layer.

7. The shoe upper of claim 4, wherein the shoe upper further comprises a heel counter, and wherein the heel edge of the floating textile layer is forward of a forward most edge of the heel counter of the shoe upper.

8. The shoe upper of claim 1, wherein the floating textile layer is fixedly coupled with the outer layer by bonding.

9. The shoe upper of claim 1, wherein the floating textile layer is fixedly coupled with the outer layer by stitching.

10. The shoe upper of claim 1, wherein the floating textile layer is substantially only fixedly coupled with the outer layer at the eyestay and at the footbed coupling portion.

11. The shoe upper of claim 1, wherein the eyestay includes a plurality of eyelets.

12. The shoe upper of claim 11, wherein the plurality of eyelets comprise embroidered eyelets.

13. The shoe upper of claim 1 further comprising a lining affixed to the inner surface of the floating textile layer.

14. The shoe upper of claim 13, wherein an apparent elongation of the floating textile layer is less than an apparent elongation of the lining in response to an equal tensile force applied to each of the floating textile layer and the lining along a same axis of orientation.

15. The shoe upper of claim 1 further comprising a plurality of channels formed in the inner surface of the outer layer and a plurality of foam portions received B within the plurality of channels, wherein an apparent elongation of the floating textile layer is less than an apparent elongation of the plurality of foam portions in response to an equal tensile force applied to each of the floating textile layer and the plurality of foam portions along a same axis of orientation.

16. The shoe upper of claim 1, further comprising a reinforcement extending around a perimeter of the floating textile layer.

17. A shoe upper comprising:

an eyestay;

a footbed coupling portion;

an outer layer having an inner surface and an outer surface; and a floating textile layer having an inner surface and an outer surface, the outer surface of the floating textile layer being fixedly coupled with the inner surface of the outer layer at the eyestay and at the footbed coupling portion, wherein the floating textile layer comprises a multi-axial material having fibers in three or more different axes of orientation;

wherein the multi-axial material comprises at least a first layer, a second layer, and a third layer, wherein the first layer comprises a first plurality of fibers extending in a first parallel orientation, the second layer comprises a second plurality of fibers extending in a second parallel orientation different than the first parallel orientation, and wherein the third layer comprises a third plurality of fibers extending in a third parallel orientation different than the first parallel orientation and the second parallel orientation.

18. The shoe upper of claim 17, further comprising a reinforcement extending around a perimeter of the floating textile layer.

* * * * *